US012016464B2

(12) United States Patent
Kang

(10) Patent No.: US 12,016,464 B2
(45) Date of Patent: Jun. 25, 2024

(54) CUSHION FOR POSTURE CORRECTION

(71) Applicant: Dae Hu Kang, Daegu (KR)

(72) Inventor: Dae Hu Kang, Daegu (KR)

( * ) Notice: Subject to any disclaimer, the term of this patent is extended or adjusted under 35 U.S.C. 154(b) by 192 days.

(21) Appl. No.: 17/593,888

(22) PCT Filed: Feb. 2, 2021

(86) PCT No.: PCT/KR2021/001376
§ 371 (c)(1),
(2) Date: Sep. 27, 2021

(87) PCT Pub. No.: WO2021/225255
PCT Pub. Date: Nov. 11, 2021

(65) Prior Publication Data

US 2022/0304474 A1 Sep. 29, 2022

(30) Foreign Application Priority Data

May 8, 2020 (KR) ..... 10-2020-0055209

(51) Int. Cl.
*A47C 20/02* (2006.01)
*A47G 9/10* (2006.01)

(52) U.S. Cl.
CPC ..... *A47C 20/026* (2013.01); *A47G 9/1063* (2013.01); *A47G 9/1081* (2013.01)

(58) Field of Classification Search
CPC ..... A47C 20/026; A47C 9/002; A47C 16/005; A47C 27/142; A47C 20/025; A47G 9/1063; A47G 9/1081; A47G 10/45; A63B 23/12; A61F 5/01; A61F 5/0111
USPC ..... 5/636, 655; D6/601
See application file for complete search history.

(56) References Cited

U.S. PATENT DOCUMENTS 2,839,766 A * 6/1958 Hull ..... A47C 20/026 5/632
3,009,172 A * 11/1961 Eidam ..... A47G 9/10 5/639
4,171,549 A * 10/1979 Morrell ..... A47C 27/086 5/655.4
4,631,766 A * 12/1986 Semmler ..... A47D 13/08 297/DIG. 2
4,944,059 A * 7/1990 Wall ..... A47C 20/025 D24/183

(Continued)

FOREIGN PATENT DOCUMENTS

JP 2012-95974 A 5/2012
KR 0140033 Y1 4/1999

(Continued)

*Primary Examiner* — Myles A Throop
(74) *Attorney, Agent, or Firm* — Saliwanchik, Lloyd & Eisenschenk

(57) ABSTRACT

Proposed is a cushion for posture correction capable of obtaining a corrective effect of a turtle neck syndrome and a straight waist syndrome just by taking a prone position. The cushion for posture correction includes: a cushion body (A) formed to be upwardly inclined toward a front and configured to support a user's upper body, wherein the cushion body (A) is formed with a cervical vertebra support part (100) protruding upward at a front end thereof so that user's neck and chin are seated and with an area concavely formed between opposite side ends where user's armpits are seated.

4 Claims, 7 Drawing Sheets

(56) References Cited

U.S. PATENT DOCUMENTS 5,103,516 A * 4/1992 Stevens ..... A47C 20/021 5/640
5,647,076 A * 7/1997 Gearhart ..... A47C 20/025 5/632
5,682,632 A * 11/1997 Cotroneo ..... A61G 13/1215 5/636
5,893,183 A * 4/1999 Bechtold, Jr. ..... A47C 20/023 128/845
6,185,768 B1 * 2/2001 Schlechter ..... A47C 20/026 5/632
D501,096 S * 1/2005 Desnos ..... D6/333
8,671,480 B1 * 3/2014 Leach ..... A47D 13/083 5/655
D823,026 S * 7/2018 Shi ..... A47C 7/383 D6/601
D915,104 S * 4/2021 Yang ..... D6/601
2006/0112490 A1 6/2006 Chausse
2007/0022537 A1 * 2/2007 Faustick ..... A47D 13/08 128/845
2012/0110742 A1 * 5/2012 Lawler ..... A61G 13/121 5/636
2012/0186025 A1 * 7/2012 Kardos ..... A47C 20/027 5/652
2012/0304387 A1 * 12/2012 Crompton ..... A47C 20/026 5/632
2013/0305455 A1 * 11/2013 Davis ..... A61G 13/1215 5/639
2015/0173516 A1 * 6/2015 Erbe ..... A47C 7/383 5/636
2015/0289664 A1 * 10/2015 Lavin ..... A47C 20/026 5/630
2016/0081485 A1 * 3/2016 Tovar ..... A47C 20/025 5/631
2016/0183685 A1 * 6/2016 Kang ..... A47G 9/1081 5/639
2017/0027345 A1 * 2/2017 Wagner ..... A47C 16/00
2019/0200774 A1 * 7/2019 Tacon ..... A47G 9/109
2020/0297122 A1 * 9/2020 Signarsson ..... A47C 16/00

FOREIGN PATENT DOCUMENTS

KR 20-0344858 Y1 3/2004
KR 20-0475488 Y1 12/2014
KR 10-2015-0057830 5/2015
WO WO-2012/170407 A2 12/2012

* cited by examiner

CUSHION FOR POSTURE CORRECTION

CROSS-REFERENCE TO RELATED APPLICATIONS

This application is the U.S. national stage application of International Patent Application No. PCT/KR2021/001376, filed Feb. 2, 2021, which claims the benefit under 35 U.S.C. § 119 of Korean Application No. 10-2020-0055209, filed May 8, 2020, the disclosures of each of which are incorporated herein by reference in their entirety.

TECHNICAL FIELD

The present disclosure relates to a cushion for posture correction and, more particularly, to a cushion for posture correction capable of obtaining a corrective effect of a turtle neck syndrome and a straight waist syndrome in a prone position.

BACKGROUND ART

In recent years, TVs, computers, mobile phones, and the like have become indispensable items in lives of modern people, and people spend a lot of time using such items. Such items provide various information and convenience to people; however, while using such items, people suffering from diseases to be described below are increasing.

Turtle neck syndrome refers to a posture in which the lower cervical vertebrae are arranged in a direction of being excessively bent and the upper cervical vertebrae and skull bones are arranged in a direction the head is tilted, whereby lordosis of the cervical vertebra is completely lost. Accordingly, turtle neck syndrome is referred to as a posture in which the head is in a state of being unable to be bowed and being pulled out forward. Such a turtle neck syndrome used to occur more with more age and muscle loss but is induced regardless of age or gender these days when people use computers or mobile phones a lot. In addition, when a turtle neck posture is chronic, normal mechanics of the cervical vertebrae collapse, causing damage to the cervical disc and accelerating the arthritis of the cervical vertebrae, so that not only pain is caused, but breathing may also be affected.

One of the diseases that occur along with the turtle neck syndrome is a straight waist syndrome, also called "kyphosis", which is the straight waist syndrome referring to a symptom in which the waist, which is to be curved, straightens or curves in an opposite direction. Such a straight waist syndrome is caused by not being able to properly support the spine due to a decrease in the muscles of the lower body as people age. However, as with the turtle neck syndrome, sitting or lying, in a bent position, while using a computer or mobile phone for a long time may cause damage to C-shaped flexion of the lower back, thereby leading to chronic pain in the back and shoulders and even to degenerative diseases.

One of the postures that may cause the above-mentioned turtle neck syndrome and the straight waist syndrome is a prone position, but many people are using the TV, computer, mobile phone, and the like in the prone position.

DISCLOSURE

Technical Problem

Accordingly, the present disclosure has been made keeping in mind the above problems occurring in the related art, and an objective of the present disclosure is to provide a cushion for posture correction capable of obtaining a corrective effect of a turtle neck syndrome and a straight waist syndrome just by taking a prone position.

Technical Solution

In order to accomplish the above objective, the present disclosure may provide a cushion for posture correction, the cushion including: a cushion body formed to be upwardly inclined toward a front and configured to support a user's upper body, wherein the cushion body may be formed with a cervical vertebra support part protruding upward at a front end thereof so that user's neck and chin may be seated and with an area concavely formed between opposite side ends where user's armpits are seated.

In addition, the cervical vertebra support part may have an upper end to be inclined downward toward the front with an upper surface formed to be concave.

In addition, the cushion body may be formed with a chest seating part and provided with a chest seating cushion, wherein the chest seating part may be inwardly invaginated at a portion where a user's chest is seated, and the chest seating cushion may have a size corresponding to the chest seating part, thereby being inserted into the chest seating part.

In addition, the cushion body may be formed with a storage space inwardly invaginated on a front side.

In addition, the cushion may further include: an auxiliary cushion formed to have a cross section in a "C" shape and mounted to surround a front end part of the cushion body, wherein the auxiliary cushion may be formed to be upwardly inclined toward the front.

Advantageous Effects

As described above, according to the present disclosure, when a user takes a prone position so that an upper body is supported with the cushion body, the user's neck and chin are seated on a cervical vertebra support part to form a gentle C-shape in which the cervical vertebrae are convexly curved forward, so that the normal C-shaped cervical vertebrae can be induced. At the same time, the user's shoulders are stretched to a back side, so that straightening of the bent shoulders are induced and the back muscles are strengthened. As a result, a turtle neck syndrome and a straight waist syndrome can be corrected or prevented just by taking the prone position.

BEST MODE

The present disclosure proposes a cushion for posture correction that includes a cushion body formed to be upwardly inclined toward a front and configured to support a user's upper body to correct or prevent a turtle neck syndrome and a straight waist syndrome just by taking a prone position, wherein the cushion body is formed with a cervical vertebra support part protruding upward at a front end thereof so that user's neck and chin are seated and with an area concavely formed between opposite side ends where user's armpits are seated.

The scope of the present disclosure is not limited to embodiments described below, and various modifications may be made by those of ordinary skill in the art without departing from the technical gist of the present disclosure.

Hereinafter, the cushion for posture correction of the present disclosure will be described in detail with reference to the accompanying FIGS. 1 to 8.

Figure 2A:
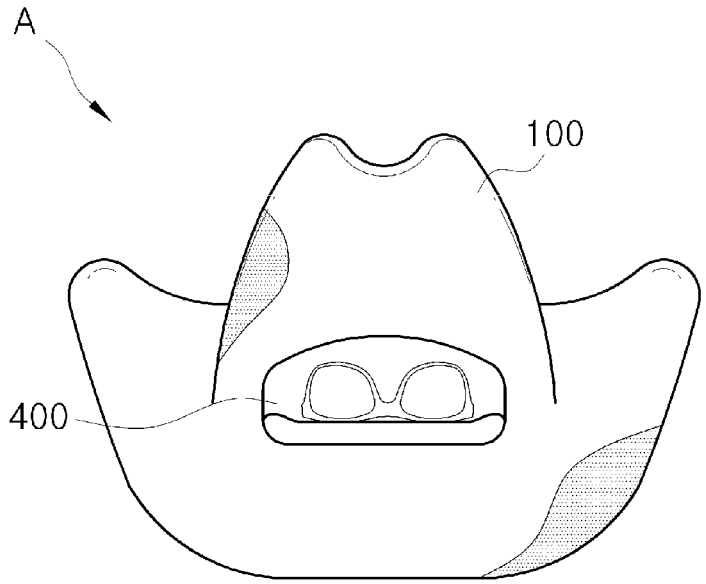
FIGS. 2A and 2B are views each showing the structure of a front surface and a side surface according to the embodiment of the cushion for posture correction according to the present disclosure.
Figure 2B:
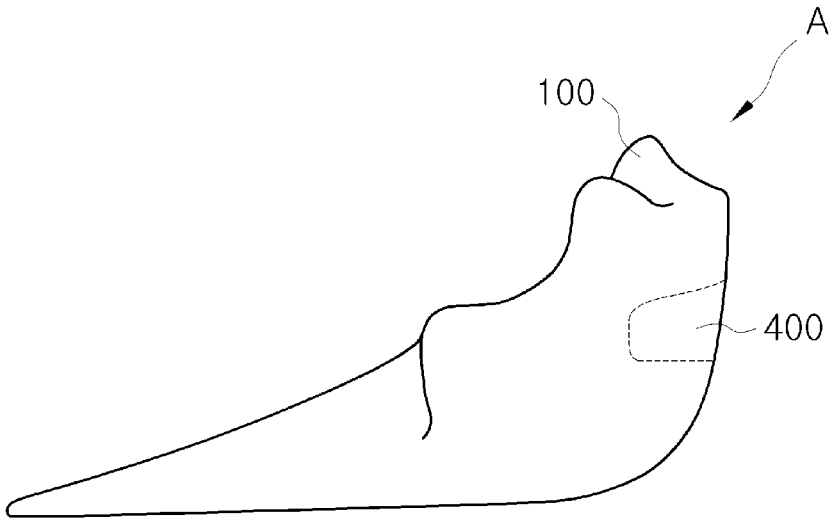
Figure 3:
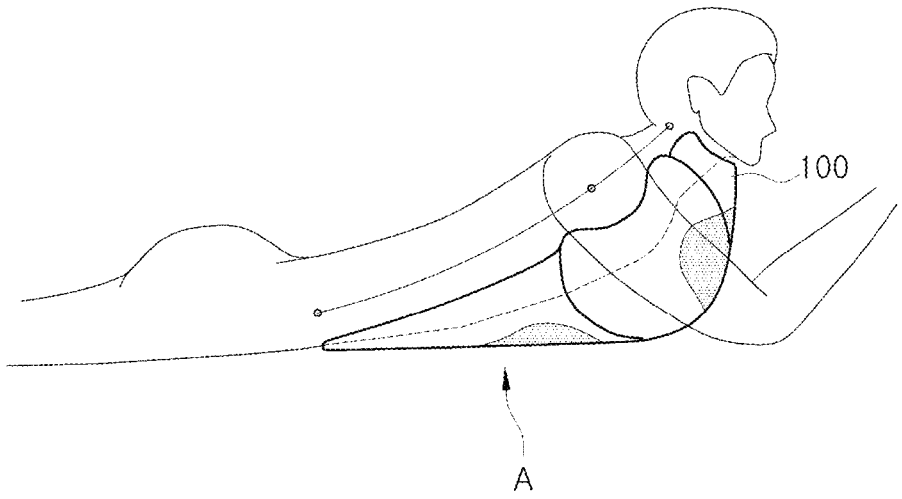
FIG. 3 is an exemplary view seen from a side surface and showing an example of using the cushion for posture correction according to the present disclosure.
Figure 4:
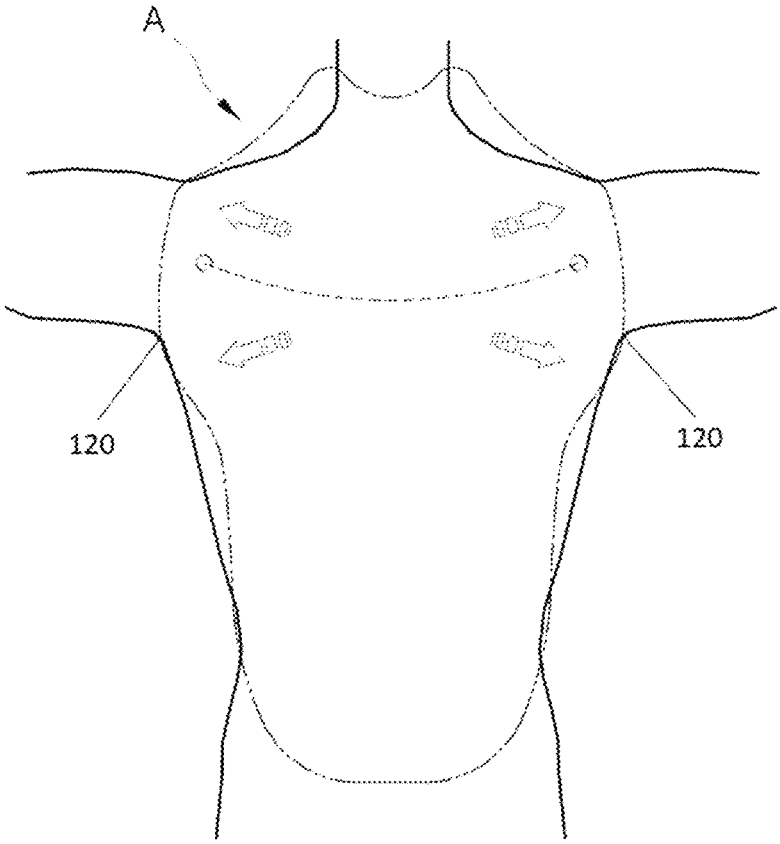
FIG. 4 is an exemplary view seen from a top plane and showing an example of using the cushion for posture correction according to the present disclosure.

The cushion for posture correction of the present disclosure includes a cushion body A configured to support the user's upper body as shown in FIGS. 1 to 4. At this time, the user means a person lying in a prone position, and the cushion body A supports the user by being in close contact with a front surface of the user's upper body as shown in FIG. 3. In addition, the maximum width of the cushion body A is formed shorter than a length between shoulders of the user as shown in FIG. 4, and the opposite ends (120) constituting the maximum width of the body A may each be formed so as to be located in a vicinity of the user's armpits. The cushion body A may be made of various materials but may be made of Ethylene Vinyl Acetate (EVA) material so that the user may feel padding.

Figure 1:
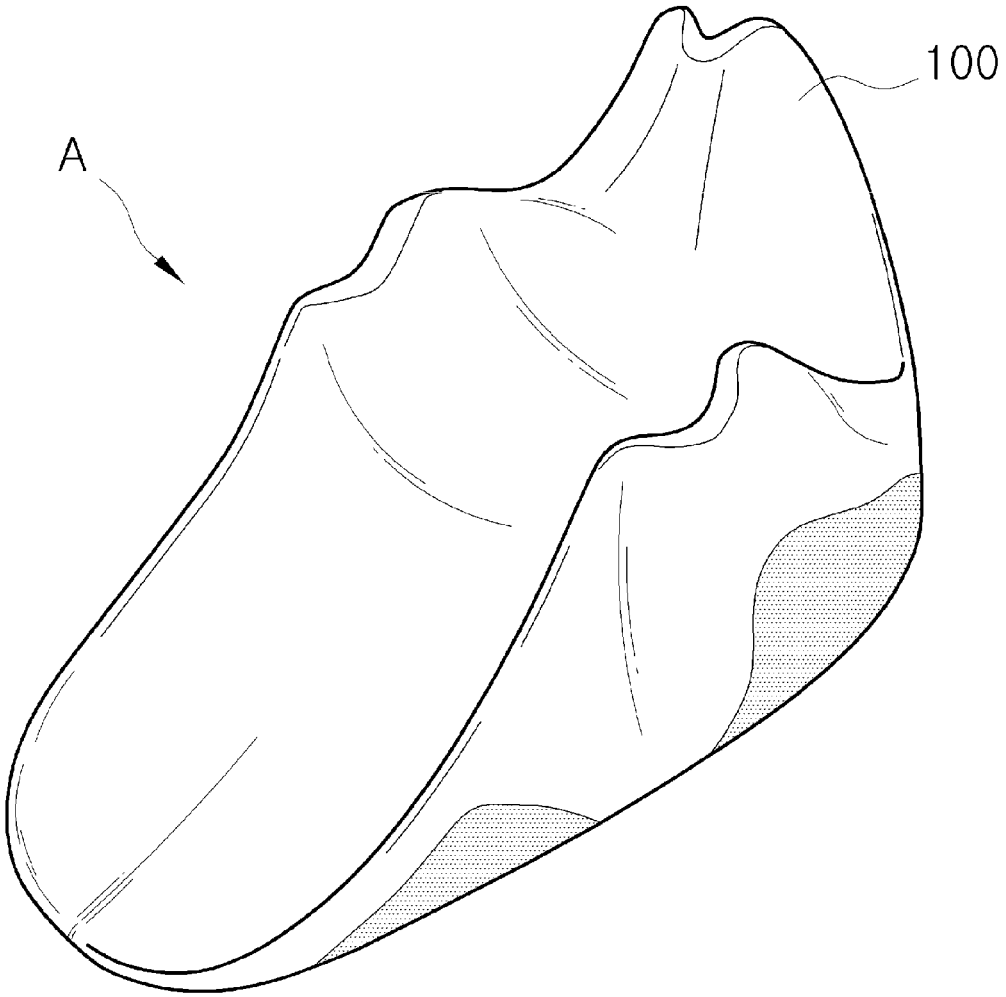
FIG. 1 is a perspective view showing a structure according to an embodiment of a cushion for posture correction according to the present disclosure.

Specifically, the cushion body A is formed to be upwardly inclined toward the front as shown in FIGS. 1, 2B, and 3, and the inclination angle of the cushion body A may be about 10° to 40°, and due to this, a user's head side is supported at a position relatively higher than a user's waist side. In addition, the cushion body A is formed with a cervical vertebra support part 100 protruding upward at the front end thereof, whereby the user's neck and chin are seated on the cervical vertebrae support part 100.

That is, the cushion body A supports from a vicinity of the waist, passing the chest, up to the neck and chin of the user taking the prone position as shown in FIG. 3. Here, the user's neck and chin form a gentle C-shape in which the cervical vertebrae are convexly bent forward while being supported by the cervical vertebra support part 100 and thus induce the cervical vertebrae to achieve a normal C-shape. Therefore, the user may obtain an effect of correcting or preventing the turtle neck syndrome.

Specifically, the cervical spine support part 100 may have an upper surface formed to be concave and be made of a soft silicone material so that the user's chin may be comfortably supported, and in order to allow a gaze of the user lying in a prone position using the cushion body A to be toward the front or slightly down from the front, an upper end may be formed to be inclined downward toward the front as shown in FIG. 2B.

Accordingly, as the user's neck is seated along a height direction of the cervical support part 100, the user's chin is seated on the upper surface of the cervical support part 100. At this time, due to the upper end of the cervical support part 100 being inclined downward, the user's cervical vertebrae may be prevented from being excessively convexly bent forward. In addition, the user may watch TV or use a laptop computer, mobile phone, and the like while using the cushion body A.

In addition, the cushion body A is formed with an area concavely formed between the opposite side ends where user's armpits are seated as shown in FIG. 1. Accordingly, the shoulders of the user lying on the cushion body A are stretched by the opposite side ends of the cushion body A as shown in FIG. 4, so the straightening of the bent shoulders may be induced, and at the same time, an effect of strengthening the back muscles may be obtained. Accordingly, it is possible to correct or prevent a straight waist syndrome. In addition, in the cushion body A, the opposite side ends where the user's armpits are seated may be formed to be concave in front and rear directions and made of a soft silicone material.

Figure 5:
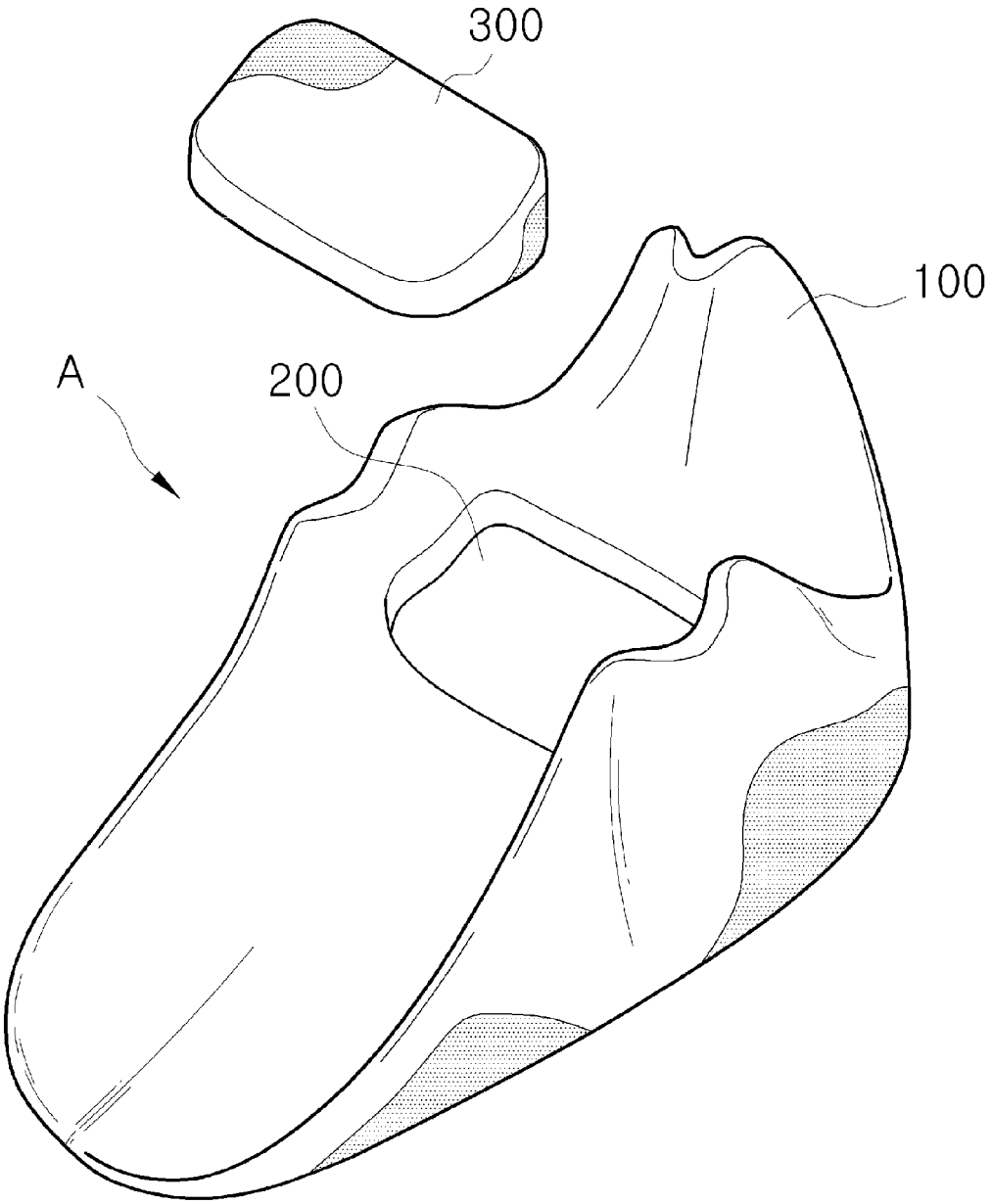
FIG. 5 is a perspective view showing a structure according to another embodiment of the cushion for posture correction according to the present disclosure.
Figure 6:
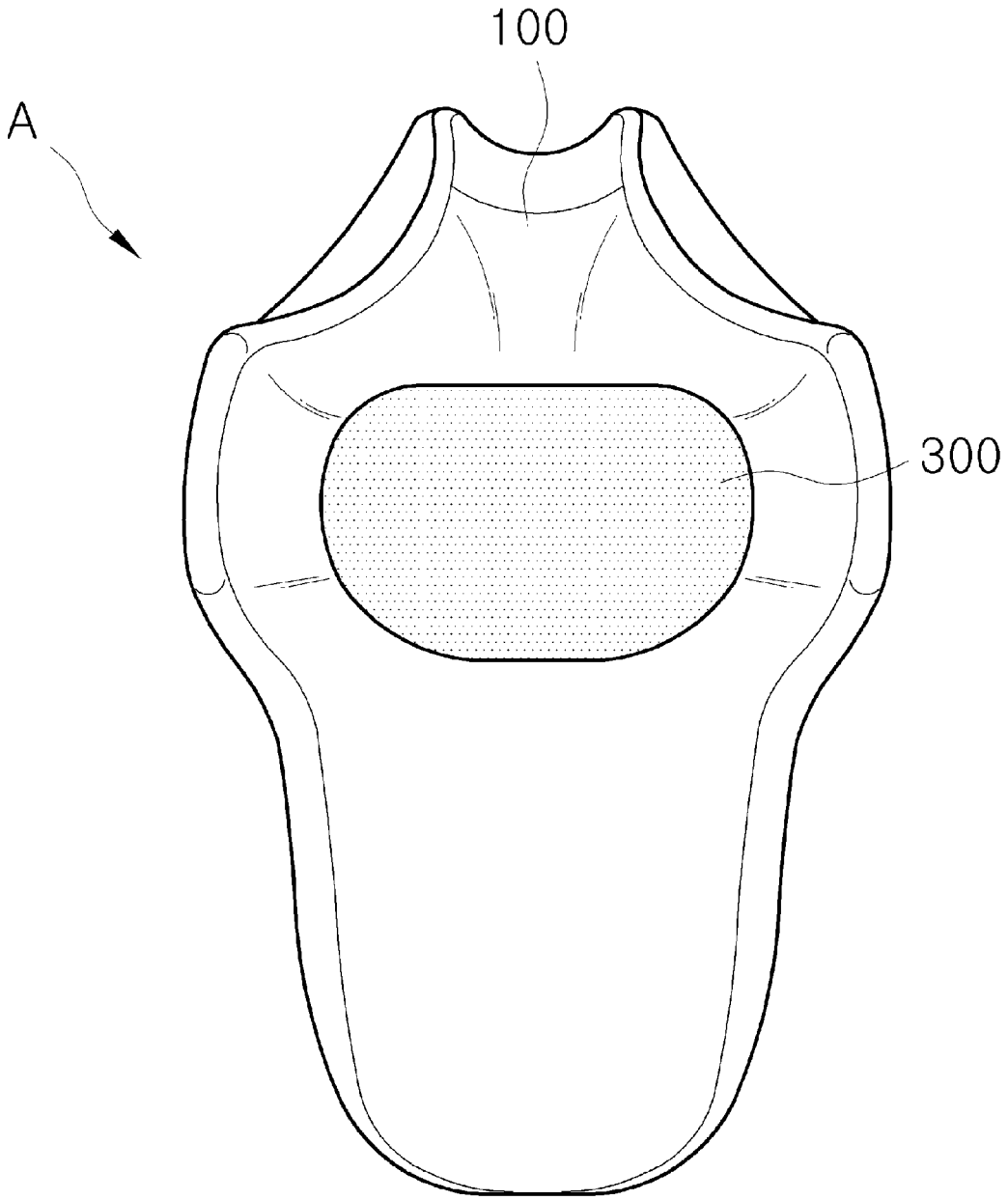
FIG. 6 is a plan view showing the structure according to another embodiment of the cushion for posture correction according to the present disclosure.

On the other hand, as shown in FIGS. 5 and 6, the cushion body A may be formed with a chest seating part 200 and provided with a chest seating cushion 300, wherein the chest seating part is a section where a user's chest is seated and which is inwardly invaginated at a portion between the opposite side ends where the user's armpits are seated, and the chest seating cushion has a size corresponding to the chest seating part 200, thereby being inserted into the chest seating part 200. Therefore, the chest seating part 200 may be selectively separated to use according to a user's body structure That is, when the user is a woman, the chest is more prominent than that of a man, so the chest is accommodated in the chest seating part 200 when taking a prone position using the cushion body A by removing the chest seating cushion 300, thereby being prevented from being compressed. On the other hand, when the user is a man, the cushion body A may be used with the chest seating cushion 300 inserted into the chest seating part 200. Therefore, the cushion body A may provide convenience according to the user's gender. Furthermore, the chest seating cushion 300 may be separated from the cushion body A to use as a separate pillow or cushion.

In addition, as shown in FIGS. 2A and 2B, the cushion body A may be formed with a storage space 400 inwardly invaginated on the front side. Such a storage space 400 may have various sizes and shapes and may store items such as glasses and a remote controller.

Figure 7:
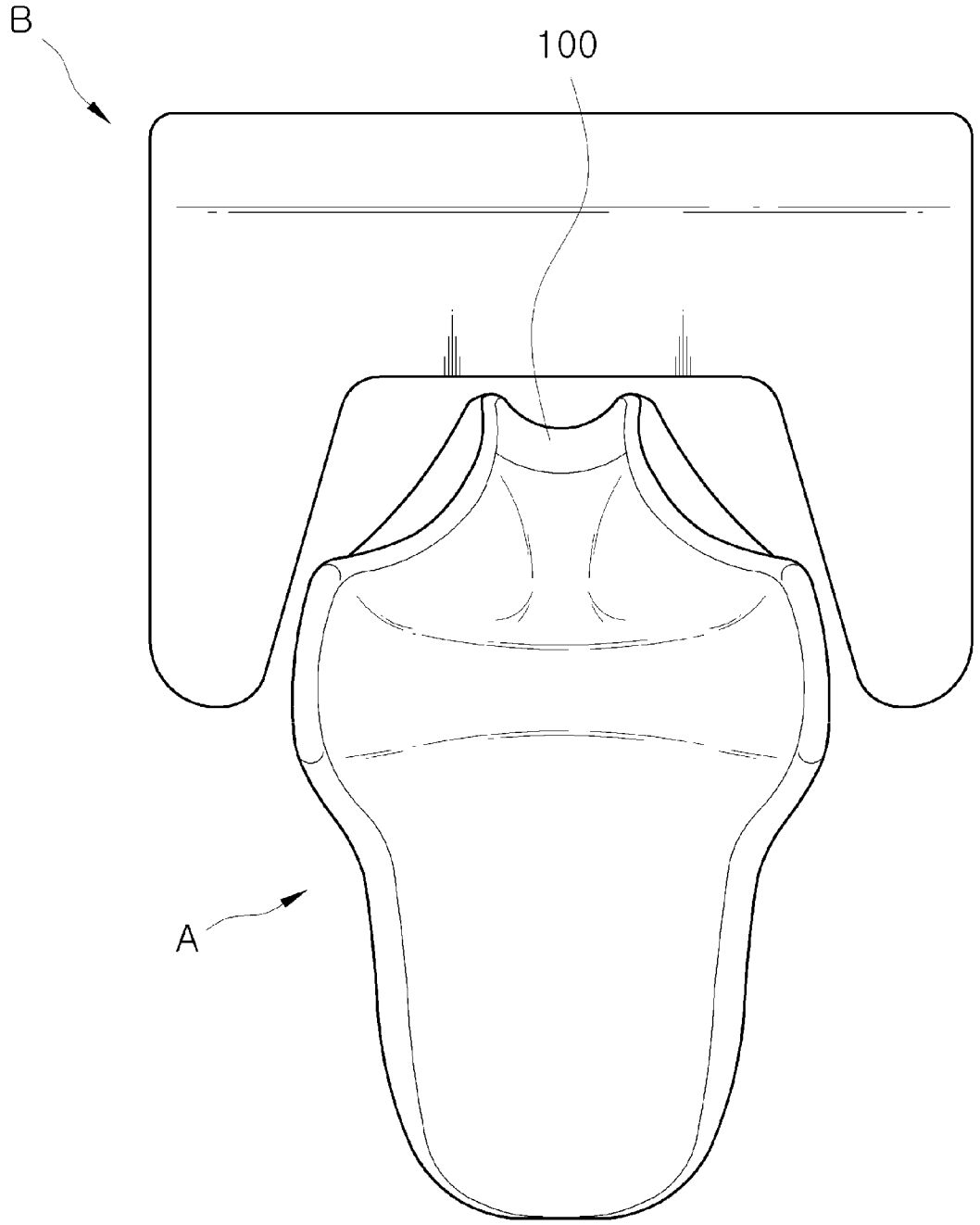
FIG. 7 is a plan view showing a structure according to still another embodiment of the cushion for posture correction according to the present disclosure.

On the other hand, the cushion for posture correction of the present disclosure may further include an auxiliary cushion B that may be used together with the cushion body A or separately from the cushion body A. As shown in FIG. 7, the auxiliary cushion B is formed to have a cross section in a "C" shape and may be mounted to surround a front end part of the cushion body A. Such an auxiliary cushion B may be used to support arms when the user lying in a prone position using the cushion body A puts his or her arms in the front, or used to put an object to be used in front of the user.

Figure 8:
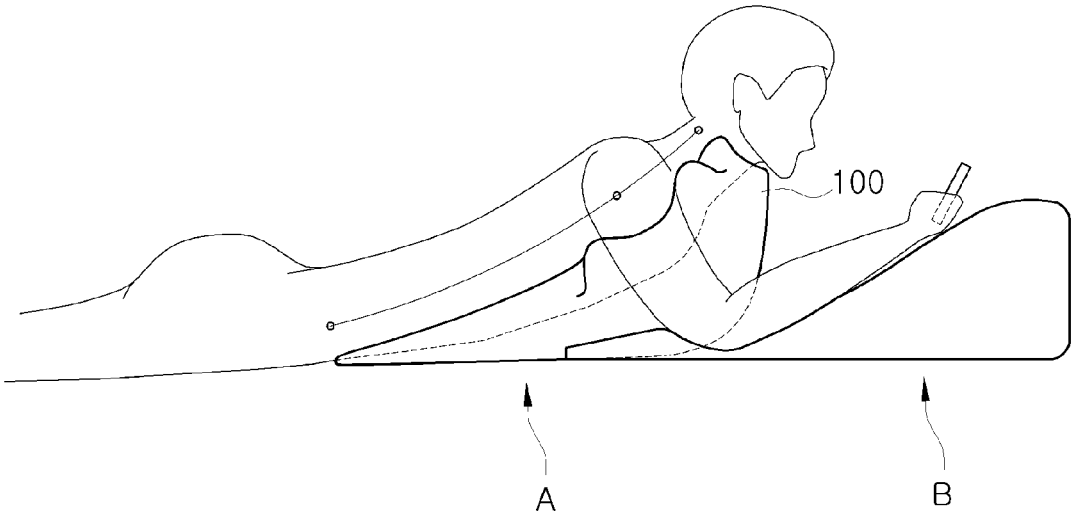
FIG. 8 is an exemplary view seen from a side surface and showing another example of using the cushion for posture correction according to the present disclosure.

As described above, the auxiliary cushion B may be formed to be upwardly inclined toward the front as shown in FIG. 8 so that the user may feel comfortable when using the auxiliary cushion B. Accordingly, the user slightly bends the arms and allows the arms to be supported with the auxiliary cushion B. Subsequently, the user may comfortably use the mobile phone and the like by allowing also items such as the mobile phone and the like to be supported with the auxiliary cushion B.

| <Description of the Reference Numerals in the Drawings> | |
|---|---|
| A: Cushion body | B: Auxiliary cushion |
| 100: Cervical vertebra support part | |
| 200: Chest seating part | |
| 300: Chest seating cushion | 400: Storage space |

The invention claimed is:

1. A cushion for posture correction, the cushion comprising:

a cushion body (A) comprising a concave upper surface, configured to support a front surface of an upper body of a user between a vicinity of a waist of the user to a neck of the user and up to a chin of the user, being upwardly inclined toward a front end, such that the user's neck and chin are higher than the user's waist and the cervical vertebra are convexly bent forward;

a cervical vertebra support part (100) that protrudes upward at the front end of the concave upper surface to form an upper surface comprising a concavity, configured to support the user's chin, wherein the concavity comprises a downward incline at the front end that directs the chin downward, an opposite side end (120) on each side of the concave upper surface, such that at least a portion of the concave upper surface is between the opposite side ends, which define therebetween a maximum width of the cushion body, and a concavity within each opposite side end, the concavity configured receive an armpit of the user.

2. The cushion of claim 1, wherein the cushion body (A) is formed with a chest seating part (200) and provided with a chest seating cushion (300), thereby being capable of selectively separating the chest seating cushion (300) to use, wherein the chest seating part is inwardly invaginated at a portion configured to receive the user's chest, and the chest seating cushion (300) has a size corresponding to the chest seating part (200), thereby being insertable into the chest seating part (200).

3. The cushion of claim 1, wherein the cushion body (A) is formed with a storage space (400) inwardly invaginated on a front side.

4. The cushion of claim 1, further comprising:

an auxiliary cushion (B) formed to have a cross section in a "C" shape and mounted to surround a front end part of the cushion body (A), wherein the auxiliary cushion (B) is formed to be upwardly inclined toward the front.

* * * * *